US010925411B2

(12) United States Patent
Ye et al.

(10) Patent No.: US 10,925,411 B2
(45) Date of Patent: Feb. 23, 2021

(54) CRIB WITH ADJUSTABLE BED POSITIONS

(71) Applicant: Ningbo Mybaby Baby & Children Products Manufacturing Co., Ltd., Ningbo (CN)

(72) Inventors: Chuanming Ye, Ningbo (CN); Ting Shi, Ningbo (CN)

(73) Assignee: Ningbo Mybaby Baby & Children Products Manufacturing Co., Ltd., Ningbo (CN)

( * ) Notice: Subject to any disclaimer, the term of this patent is extended or adjusted under 35 U.S.C. 154(b) by 183 days.

(21) Appl. No.: 16/234,031

(22) Filed: Dec. 27, 2018

(65) Prior Publication Data

US 2019/0200778 A1 Jul. 4, 2019

(30) Foreign Application Priority Data

Dec. 30, 2017 (CN) ..... 201711493313.5

(51) Int. Cl.

| | |
|---|---|
| ***A47D 9/00*** | (2006.01) |
| ***A47D 7/00*** | (2006.01) |
| *A47D 3/00* | (2006.01) |
| *A47D 5/00* | (2006.01) |

(52) U.S. Cl.

CPC ..... *A47D 9/00* (2013.01); *A47D 7/005* (2013.01); *A47D 3/00* (2013.01); *A47D 5/00* (2013.01)

(58) Field of Classification Search

CPC . A47D 9/00; A47D 7/00; A47D 7/005; A47D 7/01; A47D 7/03; A47D 3/00; A47D 3/005; A47D 5/00

See application file for complete search history.

(56) References Cited

U.S. PATENT DOCUMENTS

| | | | | |
|---|---|---|---|---|
| 3,882,556 A * | 5/1975 | Accurso | A47D 9/02 5/108 |
| 5,572,752 A * | 11/1996 | McGee | A47D 9/02 5/101 |
| 6,202,228 B1 * | 3/2001 | Cox | A47D 7/04 5/940 |
| 9,888,787 B1 * | 2/2018 | Chen | H02K 33/10 |
| 2011/0308011 A1 * | 12/2011 | Cheng | A47D 7/04 5/93.1 |
| 2016/0106226 A1 * | 4/2016 | Yi | A47D 9/00 5/11 |

* cited by examiner

*Primary Examiner* — Robert G Santos
*Assistant Examiner* — Rahib T Zaman
(74) *Attorney, Agent, or Firm* — Ladas & Parry, LLP

(57) ABSTRACT

The present invention discloses a crib whose bed position can be adjusted, including a surrounding rod and a foot tube. The foot tube includes two transverse rods. Each transverse rod is parallel to a horizontal plane. The crib whose bed position can be adjusted further includes two movable connecting rods. One end of each movable connecting rod is connected to the surrounding rod, and the other end of the movable connecting, rod is movably arranged on the transverse rod and can move along the transverse rod to adjust the bed position of the crib. A bed body is movably arranged on the foot tube by using the movable connecting rods. When the bed position needs to be moved, the foot tube does not need to be moved, and only the surrounding rod and the movable connecting rods need to be moved. The operation is convenient, and the structure is simple.

15 Claims, 5 Drawing Sheets

CRIB WITH ADJUSTABLE BED POSITIONS

CROSS REFERENCE TO RELATED APPLICATION

The present application claims the priority to Chinese Patent Application No. 2017.11493313.5 filed on Dec. 30, 2017, the disclosure of which is incorporated herein by reference in its entirety.

BACKGROUND

Technical Field

The present invention relates to a crib, and in particular, to a crib whose bed position can be adjusted.

Related Art

At present, there are a variety of cribs having simple or complex structures. A crib usually includes a bed body and a foot tube supporting the bed body. During use, the crib is usually placed near a bed of parents. Because of placement of indoor furniture, sometimes the foot tube of the crib cannot be placed in close contact with an edge of the bed of parents. Consequently, there is a distance between the bed body of the crib and the bed of parents, and it is inconvenient for parents to look after a child. In addition, when a bed position is moved, the foot tube is further caused to shake.

SUMMARY

To overcome a deficiency of the prior art, an objective of the present invention is to provide a crib whose bed position can be adjusted and whose foot tube does not shake during adjustment.

The following technical solutions are used to achieve the objective of the present invention:

A crib whose bed position can be adjusted includes a surrounding rod and a foot tube. The foot tube includes two transverse rods. Each transverse rod is parallel to a horizontal plane. The crib whose bed position can be adjusted further includes two movable connecting rods. One end of each of the movable connecting rods is connected to the surrounding rod, and the other end of the movable connecting rod is movably arranged on the transverse rod and can move along the transverse rod to adjust the bed position of the crib.

Further, a snap-fit protrusion is disposed at an end of the movable connecting rod close to the transverse rod, the transverse rod is provided with a recess, and the snap-fit protrusion is accommodated in the recess and can move along the recess.

Further, a section of the snap-fit protrusion is T-shaped.

Further, a section of the recess is T-shaped.

Further, the snap-fit protrusion is elongated.

Further, the transverse rod is partially coated at a tail end of the movable connecting rod.

Further, a mounting groove is provided at an end of the movable connecting rod close to the transverse rod, and the transverse rod is accommodated in the mounting groove and can move along the mounting groove.

Further, the transverse rod is a hollow tube.

Further, the movable connecting rods are perpendicular to the horizontal plane.

Further, the movable connecting rods are detachably connected to the surrounding rod.

Compared with the prior art, for the crib whose bed position can be adjusted in the present invention, the foot tube includes two transverse rods. Each transverse rod is parallel to the horizontal plane. The crib whose bed position can be adjusted further includes two movable connecting rods. One end of each movable connecting rod is connected to the surrounding rod, and the other end of the movable connecting rod is movably arranged on the transverse rod and can move along the transverse rod to adjust the bed position of the crib. A bed body is movably arranged on the foot tube by using the movable connecting rods. When the bed position needs to be moved, the foot tube does not need to be moved, and only the surrounding rod and the movable connecting rods need to be moved. The operation is convenient, and the structure is simple. In addition, the foot tube is a fixed framework, and the bed position more stably moves above the framework.

Figure 1:
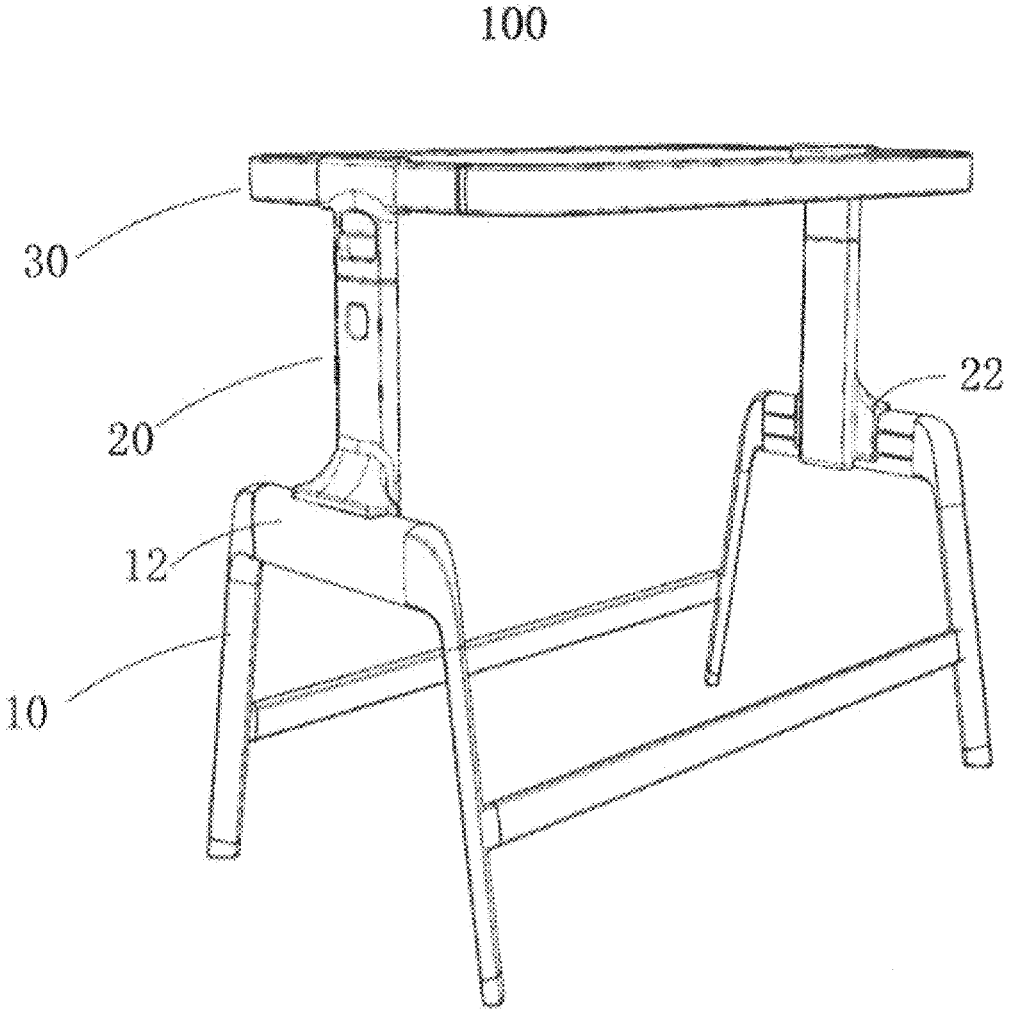
FIG. 1 is a three-dimensional diagram of a first embodiment of a crib whose bed position can be adjusted according to the present invention.

In the drawings: 100: Crib whose bed position can be adjusted; 10: Foot tube; 12: Transverse rod; 120: Recess; 20: Movable connecting rod; 22: Snap-fit protrusion; 24: Mounting groove; and 30: Surrounding rod.

DETAILED DESCRIPTION

The following clearly and completely describes the technical solutions in the embodiments of the present invention with reference to the accompanying drawings in the embodiments of the present invention. Obviously, the described embodiments are only some embodiments rather than all embodiments of the present invention. All other embodiments obtained by a person of ordinary skill in the art based on the embodiments in the present invention without creative effects shall fall within the protection scope of the present invention.

It should be noted that when a component is expressed as "fixed to" another component, the component may be directly on the another component, or a mediate component may exist between the component and the another component. When a component is considered as "connected to" another component, the component may be directly connected to the another component, or a mediate component may exist between the component and the another component. When a component is considered as "disposed on" another component, the component may be directly disposed on the another component, or a mediate component may exist between the component and the another component. Terms such as "vertical", "horizontal", "left", and "right" used in the specification and similar expressions are merely for the purpose of description.

Unless otherwise defined, meanings of all technical and scientific terms used in the specification are the same as meanings usually understood by a person skilled in the technical field of the present invention. The terms used in the specification of the present invention are only for describing specific embodiments rather than limit the present invention. A term "and/or" used in the specification includes random and all combinations of one or more related listed items.

Figure 2:
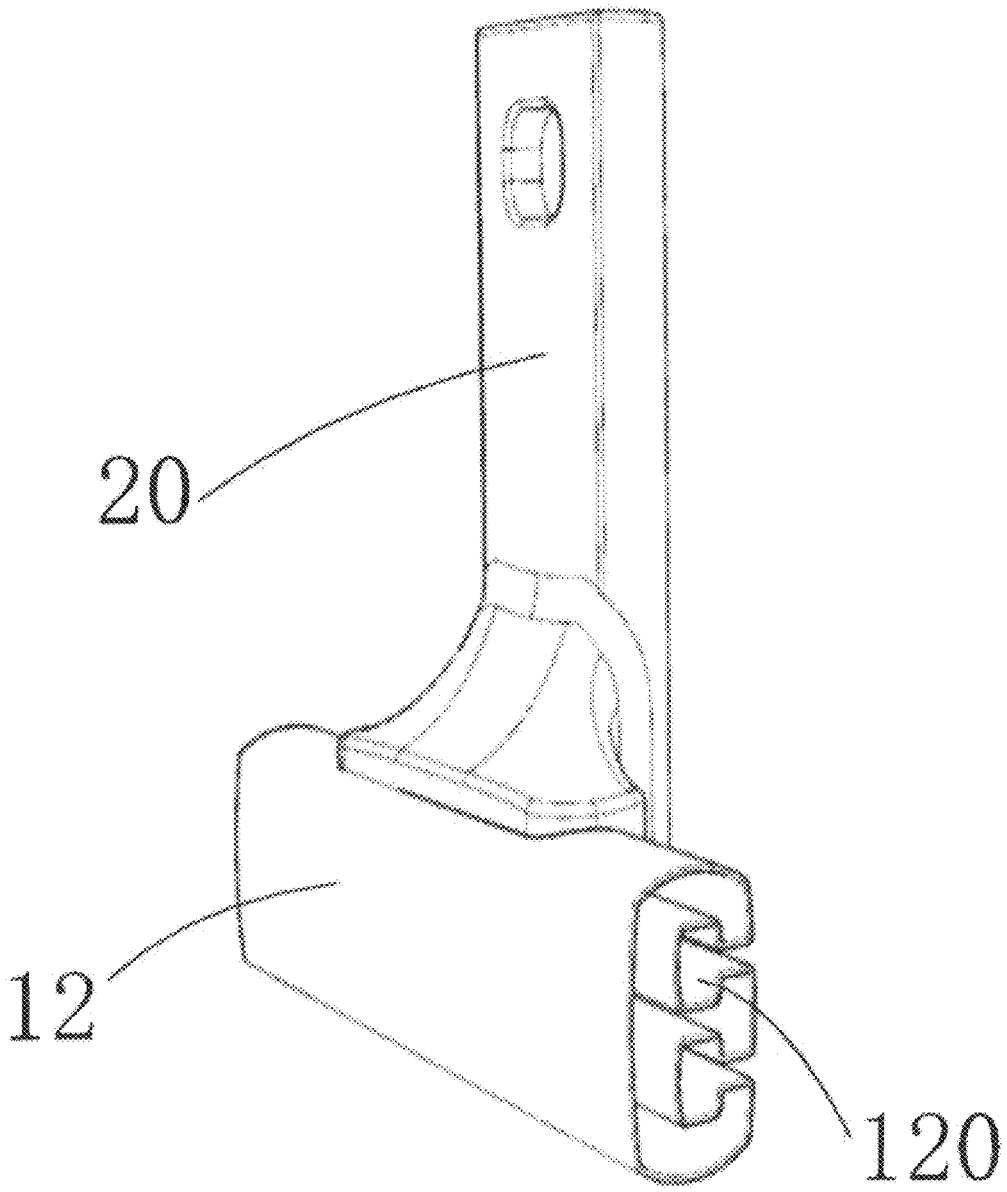
FIG. 2 is a schematic partial structural diagram of the crib whose bed position can be adjusted in FIG. 1.
Figure 3:
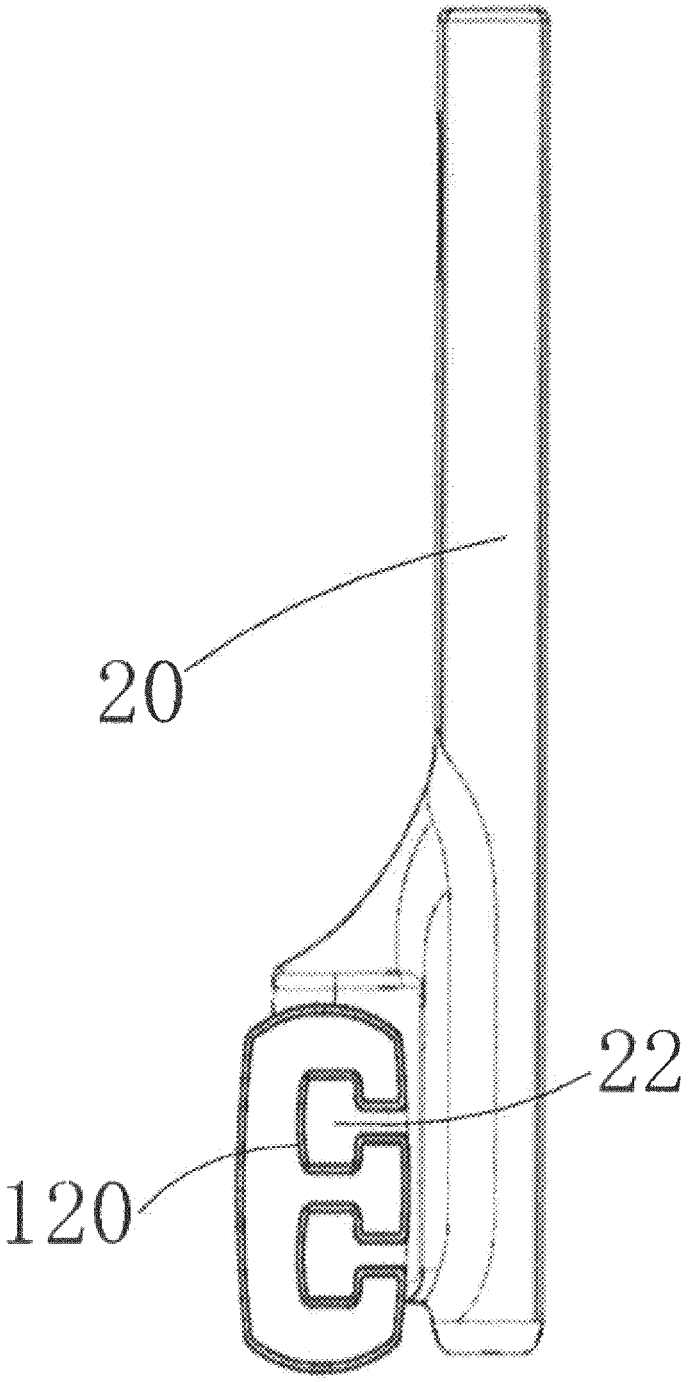
FIG. 3 is a partial structural side view of the crib whose bed position can be adjusted in FIG. 2.

Refer to FIG. 1 to FIG. 3. In a first embodiment of a crib 100 whose bed position can be adjusted in the present invention, the crib 100 whose bed position can be adjusted includes a foot tube 10, movable connecting rods 20, and a surrounding rod 30.

The foot tube 10 includes two transverse rods 12. The two transverse rods 12 are parallel to each other and are parallel to a horizontal plane. Each transverse rod 12 is hollow and is provided with two recesses 120. A section of each recess 120 is T-shaped. Each recess 120 is formed by pressing of the transverse rod 12. A protrusion is formed between the two recesses 120. A section of the protrusion is inverted T-shaped.

The movable connecting rod 20 includes two snap-fit protrusions 22. A section of each snap-fit protrusion 22 is T-shaped Each snap-fit protrusion 22 is elongated. An inverted T-shaped gap is formed between the two snap-fit protrusions 22.

When the crib 100 whose bed position can be adjusted is assembled, one ends of the two movable connecting rods 20 are respectively detachably arranged on two ends of the surrounding rod 30. The snap-fit protrusion 22 at the other end of each movable connecting rod 20 is accommodated in the recess 120 of the transverse rod 12. In this case, the transverse rod 12 is half coated at an end portion of the movable connecting rod 20. The movable connecting rods 20 are perpendicular to the horizontal plane.

When the crib 100 whose bed position can be adjusted is used, the foot tube 10 does not need to be moved, the snap-fit protrusions 22 of the movable connecting rods 20 move in the recesses 120 of the transverse rods 12, so that the movable connecting rods 20 and the surrounding rod 30 move above the foot tube 10, to achieve an effect of adjusting the bed position. The structure is simple, and the operation is convenient.

Figure 4:
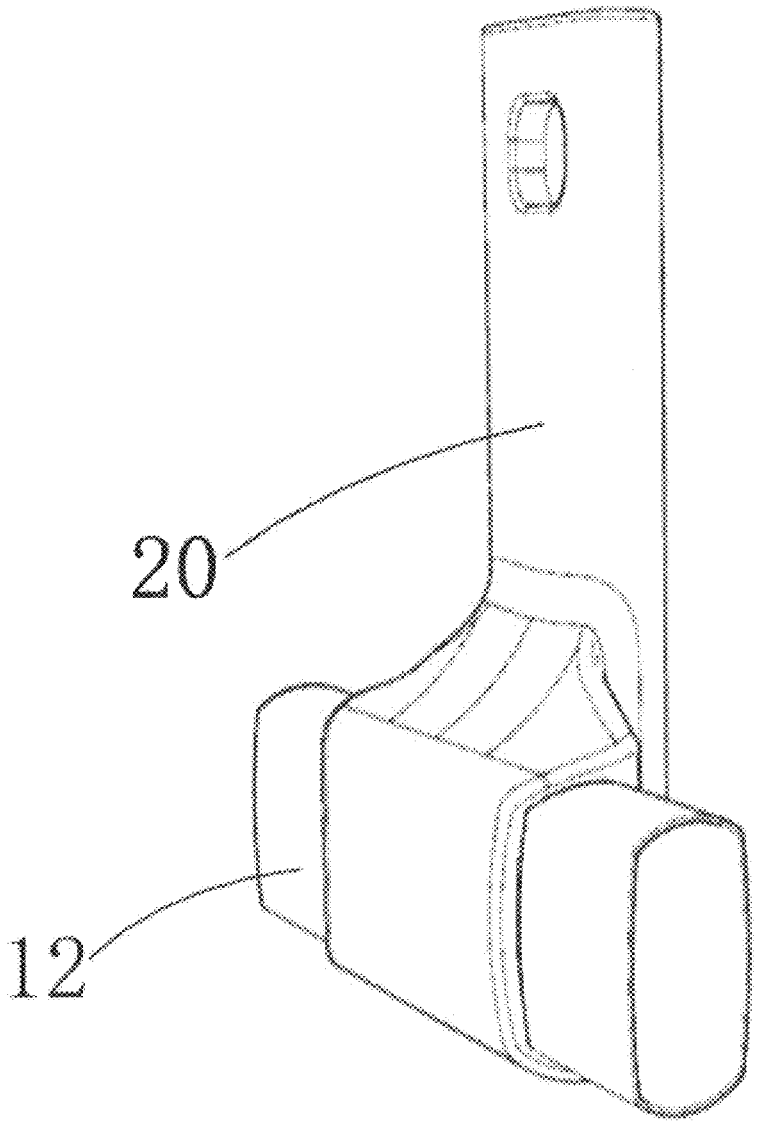
FIG. 4 is a schematic partial structural diagram of a second embodiment of a crib whose bed position can be adjusted according to the present invention.
Figure 5:
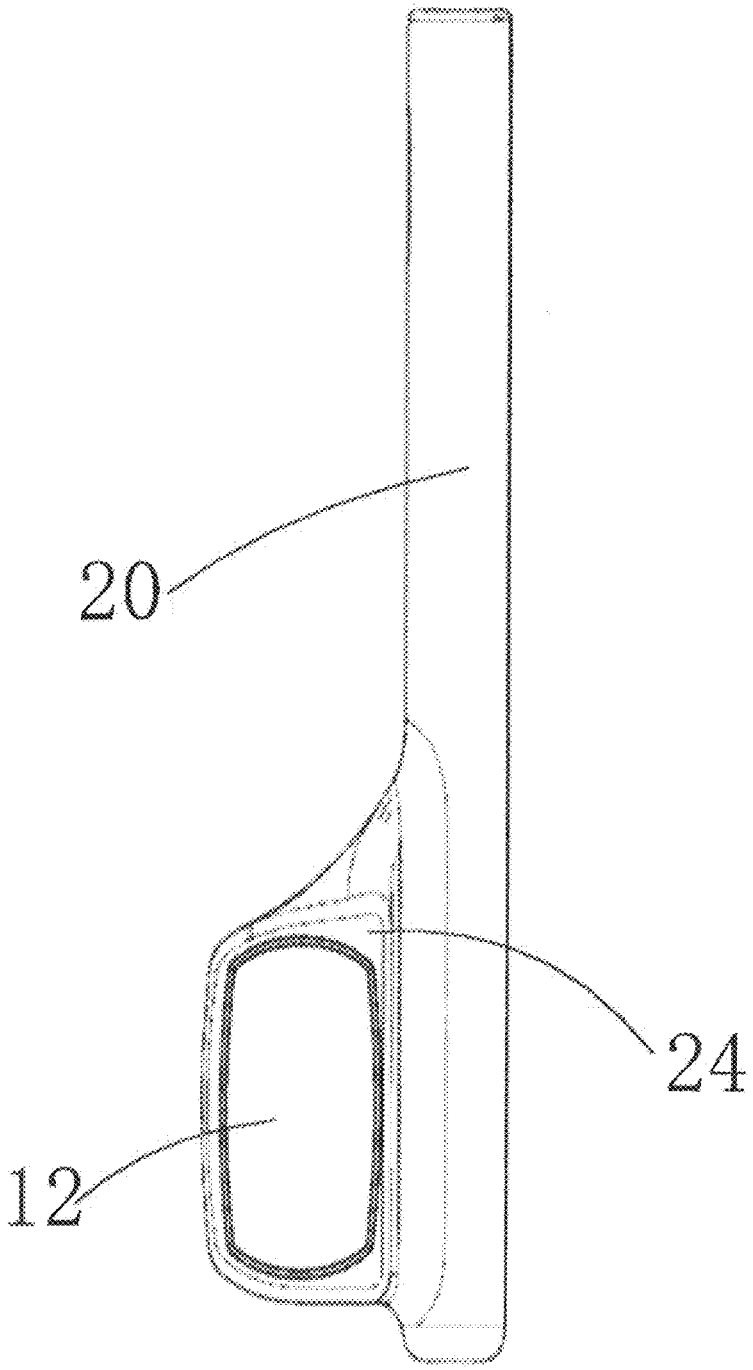
FIG. 5 is a partial structural side view of the crib whose bed position can be adjusted in FIG. 4.

FIG. 4 and FIG. 5 show a second embodiment of a crib 100 whose bed position can be adjusted according to the present invention. In the second embodiment, a structure of the crib 100 whose bed position can be adjusted is substantially the same as that in the first embodiment. A difference lies in that a mounting groove 24 is provided at a tail end of a movable connecting rod 20, and a transverse rod 12 is accommodated in the mounting groove 24 and moves along the mounting groove 24, so that the movable connecting rods 20 and a surrounding rod 30 move above a foot tube 10, to achieve an effect of adjusting the bed position. The structure is simple, and the operation is convenient. In addition, the transverse rod 12 in this case is completely coated at a tail end of the movable connecting rod 20.

A person skilled in the art can make other various corresponding changes and modifications according to the foregoing technical solutions and concepts, and all these changes and modifications shall fall within the protection scope of the claims of the present invention.

What is claimed is:

1. A crib with adjustable bed position, comprising a surrounding rod and a foot tube, wherein the foot tube comprises two transverse rods, and each transverse rod is parallel to a horizontal plane, the crib whose bed position can be adjusted further comprising two movable connecting rods, wherein one end of each of the movable connecting rods is connected to the surrounding rod, and the other end of the movable connecting rod is movably arranged on the transverse rod and can move along the transverse rod to adjust the bed position of the crib, wherein a snap-fit protrusion is disposed at an end of the movable connecting rod close to the transverse rod, the transverse rod is provided with a recess, and the snap-fit protrusion is accommodated in the recess and can move along the recess.

2. The crib according to claim 1, wherein a section of the snap-fit protrusion is T-shaped.

3. The crib according to claim 1, wherein a section of the recess is T-shaped.

4. The crib according to claim 1, wherein the snap-fit protrusion is elongated.

5. The crib according to claim 1, wherein the transverse rod is partially coated at a tail end of the movable connecting rod.

6. A crib with adjustable bed position, comprising a surrounding rod and a foot tube, wherein the foot tube comprises two transverse rods, and each transverse rod is parallel to a horizontal plane, the crib whose bed position can be adjusted further comprising two movable connecting rods, wherein one end of each of the movable connecting rods is connected to the surrounding rod, and the other end of the movable connecting rod is movably arranged on the transverse rod and can move along the transverse rod to adjust the bed position of the crib, wherein a mounting groove is provided at an end of the movable connecting rod close to the transverse rod, and the transverse rod is accommodated in the mounting groove and can move along the mounting groove.

7. The crib according to claim 6, wherein the transverse rod is a hollow tube.

8. A crib with adjustable bed position, comprising a surrounding rod and a foot tube, wherein the foot tube comprises two transverse rods, and each transverse rod is parallel to a horizontal plane, the crib whose bed position can be adjusted further comprising two movable connecting rods, wherein one end of each of the movable connecting rods is connected to the surrounding rod, and the other end of the movable connecting rod is movably arranged on the transverse rod and can move along the transverse rod to adjust the bed position of the crib, wherein the movable connecting rods are perpendicular to the horizontal plane.

9. The crib according to claim 1, wherein the movable connecting rods are detachably connected to the surrounding rod.

10. The crib according to claim 8, wherein a mounting groove is provided at an end of the movable connecting rod close to the transverse rod, and the transverse rod is accommodated in the mounting groove and can move along the mounting groove.

11. The crib according to claim 10, wherein the transverse rod is a hollow tube.

12. The crib according to claim 8, wherein a section of the snap-fit protrusion is T-shaped.

13. The crib according to claim 8, wherein a section of the recess is T-shaped.

14. The crib according to claim 8, wherein the snap-fit protrusion is elongated.

15. The crib according to claim 8, wherein the transverse rod is partially coated at a tail end of the movable connecting rod.

* * * * *